US006695404B2

(12) United States Patent
Brüske

(10) Patent No.: US 6,695,404 B2
(45) Date of Patent: Feb. 24, 2004

(54) CHAIR

(75) Inventor: Joachim Brüske, Berlin (DE)

(73) Assignee: Haworth Büroeinrichtungen GmbH, Berlin (DE)

( * ) Notice: Subject to any disclaimer, the term of this patent is extended or adjusted under 35 U.S.C. 154(b) by 0 days.

(21) Appl. No.: 10/343,044

(22) PCT Filed: May 23, 2001

(86) PCT No.: PCT/EP01/05907

§ 371 (c)(1),
(2), (4) Date: Jan. 27, 2003

(87) PCT Pub. No.: WO01/91614

PCT Pub. Date: Dec. 6, 2001

(65) Prior Publication Data

US 2003/0184140 A1 Oct. 2, 2003

(30) Foreign Application Priority Data

May 27, 2000 (DE) ..... 100 26 475

(51) Int. Cl.[7] ..... A47C 1/032
(52) U.S. Cl. ..... 297/316; 297/320; 297/300.2
(58) Field of Search ..... 297/316, 320, 297/321, 319

(56) References Cited

U.S. PATENT DOCUMENTS 5,071,189 A * 12/1991 Kratz ..... 297/320
5,366,274 A * 11/1994 Roericht et al. ..... 297/321
5,660,439 A * 8/1997 Unwalla ..... 297/316
5,931,531 A * 8/1999 Assmann ..... 297/316
6,109,694 A * 8/2000 Kurtz ..... 297/320

* cited by examiner

*Primary Examiner*—Anthony D. Barfield
(74) *Attorney, Agent, or Firm*—Pauley Petersen & Erickson

(57) ABSTRACT

A chair, in particular a work or office chair, having a seat mounted onto a chair frame. The front region of the seat can be inclined about a horizontal, pivoting shaft which is displaced upwards and downwards, following a spatial guide curve in relation to the chair frame. The seat is also connected in an articulated manner to a rocker which is directed upwards and extends backwards from an articulated rocker bearing fixed to the chair frame and which is connected at a distance from the rear edge of the seat, or at the side of said seat. The chair also includes a backrest which is attached to the section of the rocker that is directed upwards, the inclination of the backrest being disproportionately altered, in a forced manner, with the alteration of the inclination of the seat. This invention achieves an increased apex angle between the backrest and the seat, together with a uniform displacement because the backrest is coupled to the rocker by a coupling point and the seat is also coupled to the backrest by a control lever assembly, which is used to incline the backrest backwards in relation to the rocker, when the seat is inclined.

28 Claims, 5 Drawing Sheets

CHAIR

BACKGROUND OF THE INVENTION

1. Field of the Invention

This invention relates to a chair, in particular a work or office chair, having a seat, which is placed on a chair frame and can be tilted in a front area around a horizontal pivot shaft, which can be moved up and down on a spatial guide curve in relation to the chair frame, and which is hingedly connected to a rocker extending toward the rear from an articulated rocker bearing fixed on the chair frame and is thereafter spaced apart from the seat rear edge, or is laterally guided upward next to the seat. The chair also has a backrest coupled to the upward guided section of the rocker, with a tilt that is forcibly changed superproportionally when the tilting of the seat is changed.

2. Discussion of Related Art

An office chair is known from German Patent Reference DE 39 16 474 C2. With this known chair, the front end section of a rocker-like pivot lever extending under the seat is tiltably fastened on a bearing bracket of the chair frame, while a section, which is spaced apart from the rear edge of the seat and leads upward, supports the back rest.

In a front area the seat is placed on a horizontal pivot shaft which, when the seat is tilted toward the rear, is moved together with it downward and backward, while at the same time the backrest is superproportionally tilted toward the rear. With its section extending underneath the seat, the pivot lever is also connected via an intermediate piece with the underside of the seat between the center and rear areas of the latter. When tilting the seat and the backrest, the distance between the rear edge of the seat and the lower edge of the backrest remains substantially the same, so that a so-called shirt-pulling effect is prevented to a large extent. Pressure on the backs of the knees is also avoided, because the backward tilting of the seat the front of the seat simultaneously moves downward.

Another chair with a synchronization mechanism between the seat and the backrest is disclosed by German Patent Reference DE 87 13 972 U1.

With such synchronization mechanisms for the simultaneous movement of the seat and the back, applicable specifications cite a transmission ratio in the range between 1.5 and 3.5. With customary chairs of the above mentioned type an opening angle range between the seat and the backrest of 87° to 110°, for example, is achieved. Larger backward tilts, in particular of the backrest, are desired at many work stations, for example air traffic control centers or PC work stations, but cannot be satisfactorily achieved by present synchronization mechanisms, because sequence errors occur at larger opening angles, for example relative movements between the back and the backrest that are too large, so that a shirt-pushing effect occurs. A wrong synchronization ratio between the backrest and the seat is present, increasing a distance of the lower backrest area from the pelvis, so that an ergonomically disadvantageous gap occurs because of the pelvis rolling back, and sinking the lower backrest edge during backward tilt, so that a continuous seat surface is not achieved.

SUMMARY OF THE INVENTION

One object of this invention is to provide a chair of the type mentioned above but which provides an improved sequence control of the synchronous movement between the seat and the backrest, along with the possibility of larger opening angles, and therefore tilt angles of the backrest toward the back.

This object is achieved with this invention according to the characteristics set forth in this specification and in the claims. In one embodiment, the backrest is hingedly coupled with the rocker via a coupling point, and the seat is additionally coupled with the backrest via a control lever arrangement, by which the backrest is tilted backward with respect to the rocker when the seat is tilted backward. With the articulated coupling of the backrest with the rocker and because of the control lever arrangement, the backrest can also be tilted with respect to the rocker during the tilt movement, so that a larger opening angle between the seat and the backrest, along with an even and exactly controllable sequential movement, is achieved. During this, the pelvis is supported by the lower backrest area over the entire course of the tilting, wherein a shirt-pushing effect is prevented even at large angles of tilt and a feeling of pleasant seating is conveyed. An easily attainable opening range lies, for example, between at least 87° to 120°.

For bringing the seat and the backrest into the active, forward oriented work position the structure can have a rocker bearing with a torsion rod, which prestresses the rocker against a setting limitation, which limits its tilting position toward the front. An advantageous structure for achieving the synchronization movement at a large opening angle range is assisted if the control lever arrangement has a lever, which is articulated on the upward guided section of the rocker at a joint location below the coupling point, which is hingedly coupled with an upper lever section via a connecting point with the backrest, and is hingedly coupled with a lower lever section with the rear area of the seat. A coupling piece hingedly connected at a lever connection point of the lower lever section, and at a seat connection point of the rear area of the seat, also help provide an accurate control, along with a simple construction.

In one embodiment, a measure for connecting the seat to the lever arrangement includes a lower seat element projecting past the rear edge of a seat support and the control lever arrangement connected to the projecting section of the lower seat element. Alternatively, the control lever arrangement can be connected to the lower seat element, beneath or at the side of the seat.

For example, the placement of the chair backrest for performing the synchronized tilt movement is simply achieved with a backrest rocker provided by two articulated connections at the ends for connecting the chair backrest to the upward guided section of the rocker, or at least one articulated connection is replaced by a thrust linkage.

A dependable tilted placement of the seat is achieved because, for connecting the seat with the chair frame, seat rockers are arranged on both sides underneath the front area of the seat, one end of which is hingedly placed on the pivot shaft and the other on the front area of the chair frame, or a thrust linkage is provided in the frontal seat area. It is advantageous if the seat rockers are arranged so that their ends facing the pivot shaft move downward when the seat is tilted back.

The measure by which the seat is connected between its center and rear areas with a connecting piece, or hingedly directly with the rocker, also helps achieve the synchronous movement.

A stable placement of the seat and the backrest are aided because two lateral rocker elements are provided, which are connected with each other by at least one cross brace and whose one, forward projecting section extends at a distance underneath the seat, or laterally thereof, while its upward extending section is spaced apart from the back of the backrest, or laterally thereof. For example, in this embodiment the rocker extends upward in the front lateral seat area and then toward the rear, and can be embodied as an armrest on both sides. In connection with this, the control of the synchronous movement can be simply achieved because the control lever arrangement extends in an approximately center vertical plane between the two rocker elements and is also spaced apart from the back of the backrest.

Moreover, an advantageous play-free movement is accomplished with a spring force that is effective in the pulling direction between the articulated connecting point and the articulated connecting point at the rocker.

An ergonomically advantageous support of the head is achieved with head support coupled to an extension, which projects past the upper edge of the backrest, of a lever mechanism for the synchronous adjustment of the seat and the backrest. The lever mechanism is embodied so that, when the backrest is tilted back, the head support is tilted back over a narrower tilt angle than the backrest. Because of the relative movement between the head support and the backrest, the head is guided forward during increasing tilt, and the neck muscles are relieved, while the field of view is maintained. To simply achieve this, there is a rigid or hingedly connected, mechanically controlled extension portion, of the rocker.

An adjustment possibility for the tilting of the backrest results from the coupling element being length-adjustable.

The lever can be manually released because it is connected with the rear area of the seat by a manually actuable adjusting element.

A conventional synchronization mechanism can be realized by removing the coupling rod and locking the backrest joints.

BRIEF DESCRIPTION OF THE DRAWINGS

This invention is explained in greater detail in view of an exemplary embodiment, wherein.

DESCRIPTION OF PREFERRED EMBODIMENTS

Figure 1:
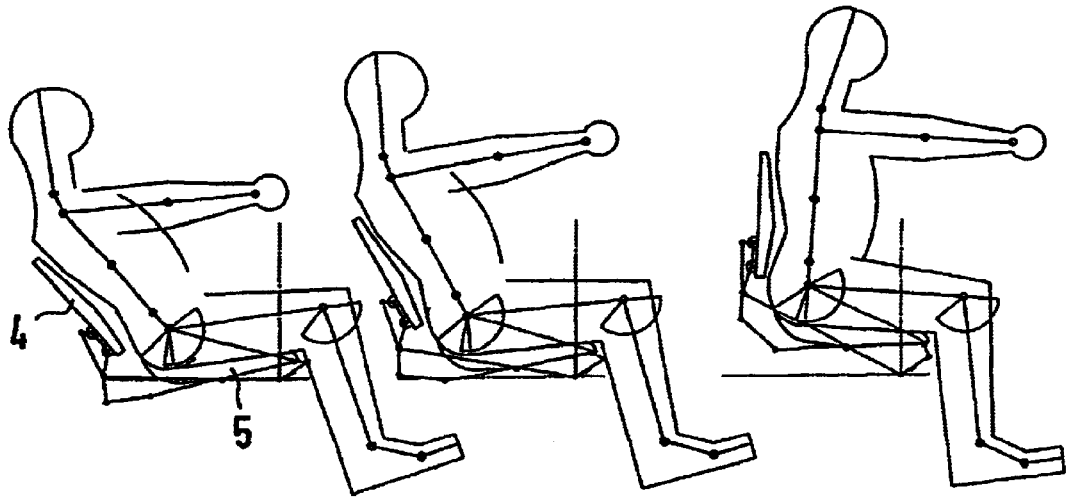
FIG. 1 shows three schematic position representations, a movement sequence in connection with a seat tilt and a backrest tilt synchronized with it.
Figure 2:
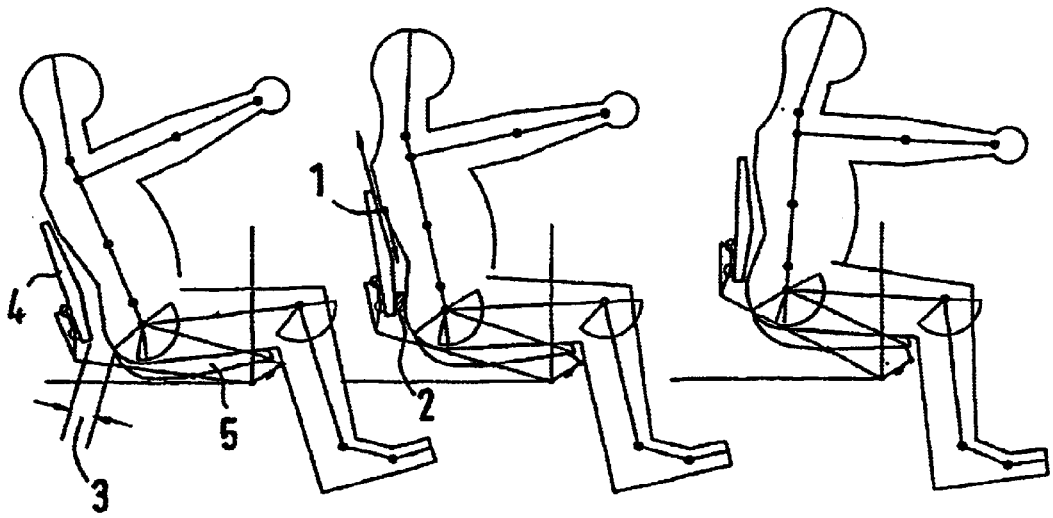
FIG. 2 shows three schematic position representations of the movement sequence of a synchronized seat and backrest tilt of a chair in accordance with the prior art.
Figure 3:
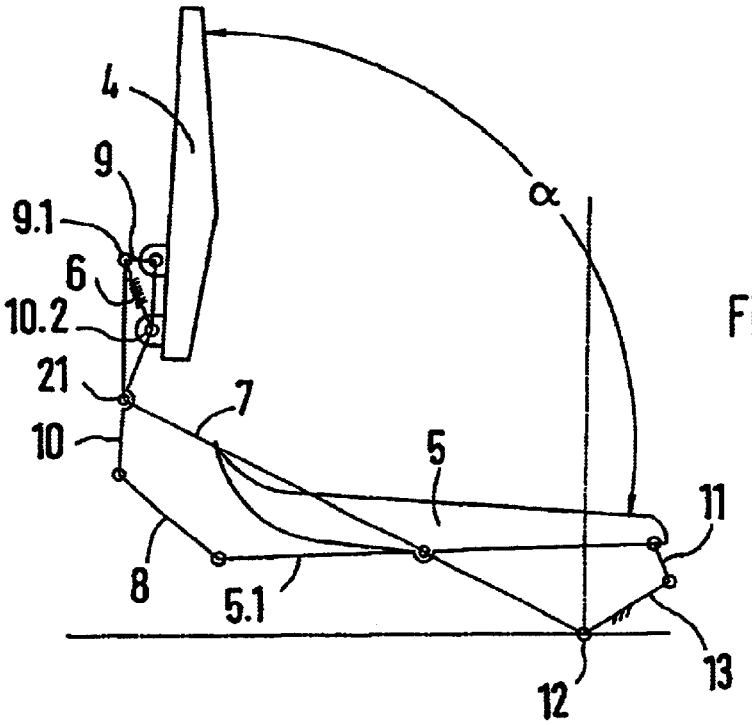
FIG. 3 shows an enlarged schematic representation of the seat and the backrest, which are connected by a synchronization mechanism.

Three different seat and backrest tilts in connection with an expanded synchronization mechanism are shown in FIG. 1, in three position representations. The backrest 4 can be tilted relative to the seat 5 over a substantially greater opening range than with a conventional synchronization mechanism, such as shown in FIG. 2 for comparison. The expanded synchronization mechanism is schematically explained in FIG. 3 and shown in various representations by an exemplary embodiment in FIGS. 6 to 9.

Figure 6:
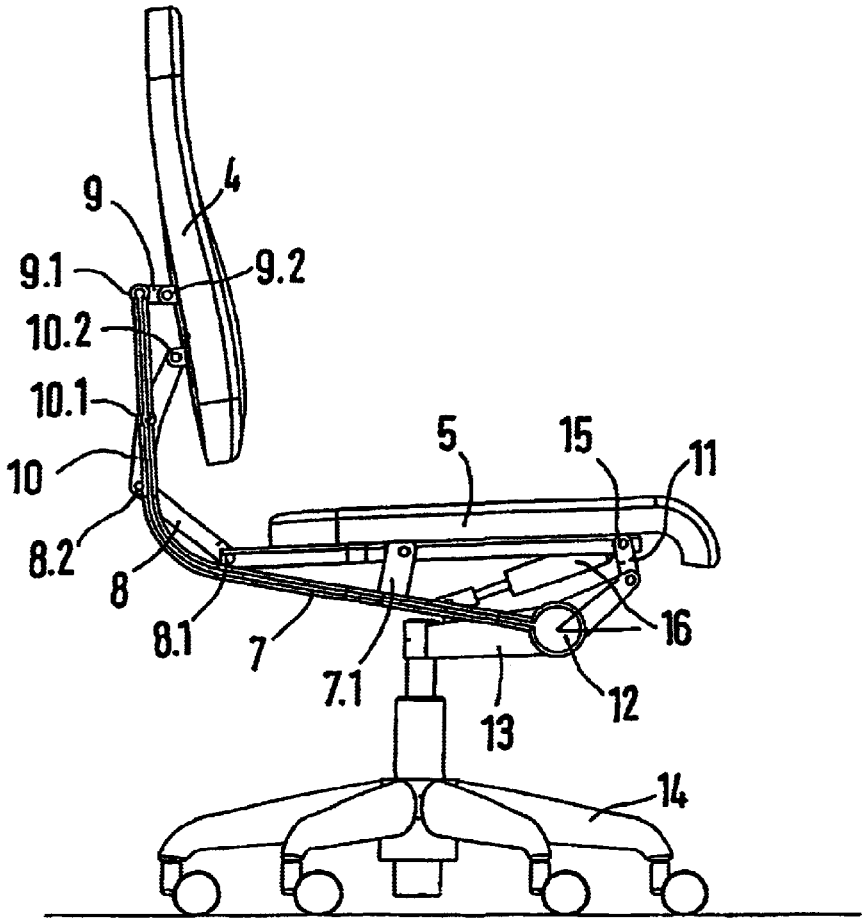
FIGS. 6 and 7 each show a lateral representation of an exemplary embodiment of the chair in two different tilted positions of the seat and the backrest.
Figure 7:
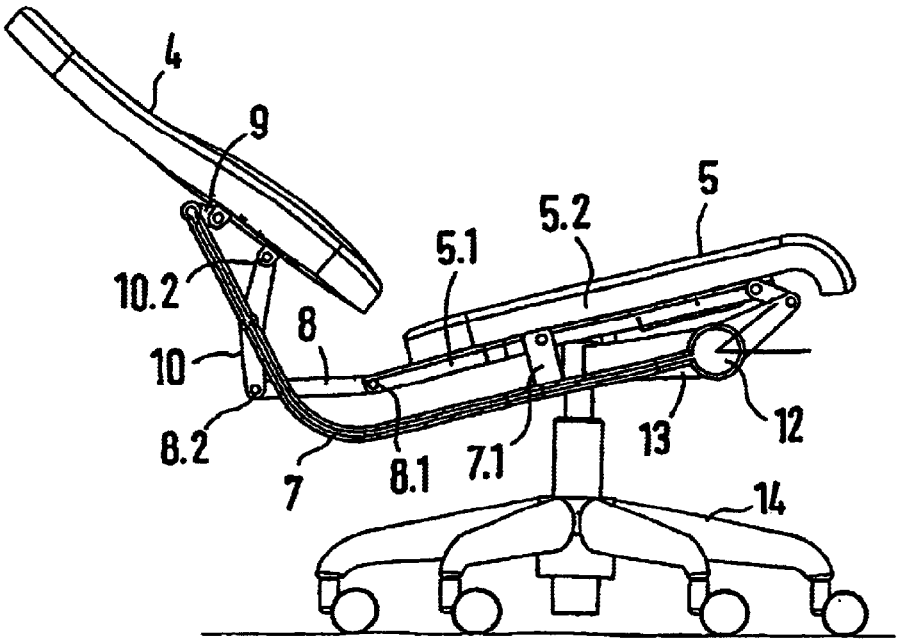

The expanded synchronization mechanism has a number of articulated points, in which different lever elements are connected with each other. The movement of the backrest 4 and the seat 5 takes place around body-related virtual pivot points, so that the spine is supported in an ergonomically advantageous manner during seating. A seat rocker 11, oriented obliquely upward and toward the back, is hingedly connected by an upper section with a pivot shaft 15 on the seat, and by a lower section it is hingedly connected to a protruding section of a bearing block of a chair frame 13. Such seat rockers 11 are provided on both sides of the seat 5. A lower section of a rocker 7 extends from a front rocker bearing 12, which has a torsion rod, beyond the rear edge of the seat 5 and continues in an upward oriented section on the back of the backrest 4, spaced apart from the backrest 4. The lower part of the rocker 7 is hingedly connected with the seat 5 approximately in its center or its rear half by a connecting element 7.1, as shown in FIGS. 6 and 7, on a lower seat element 5.1. In the end area of the upward extending section, the rocker 7 is connected via a backrest rocker 9, which is hingedly connected at an articulated connection 9. 1, with the backrest 4 via a further articulated connection 9.2 of the backrest rocker 9.

On the lower seat element 5.1 there is a section, which is extended toward the back past a seat support 5.2, and in its rear area a coupling element 8 in the form of a coupling rod is hingedly connected to a seat connecting point 8.1, while its other end is connected at a lever connection point 8.2 with the lower area of an upward extending lever 10. The lever 10 is hingedly seated at an articulated point 10.1 with a coupling member 21 on the upward extending section of the rocker 7, and with an upper section is hingedly attached at a connection point 10.2 to the back of the backrest 4. A spring element 6 in the form of an extension spring is suspended between the articulated connection 9.1 and the connecting point 10.2 for reducing play and for possible force compensation.

Figure 9:
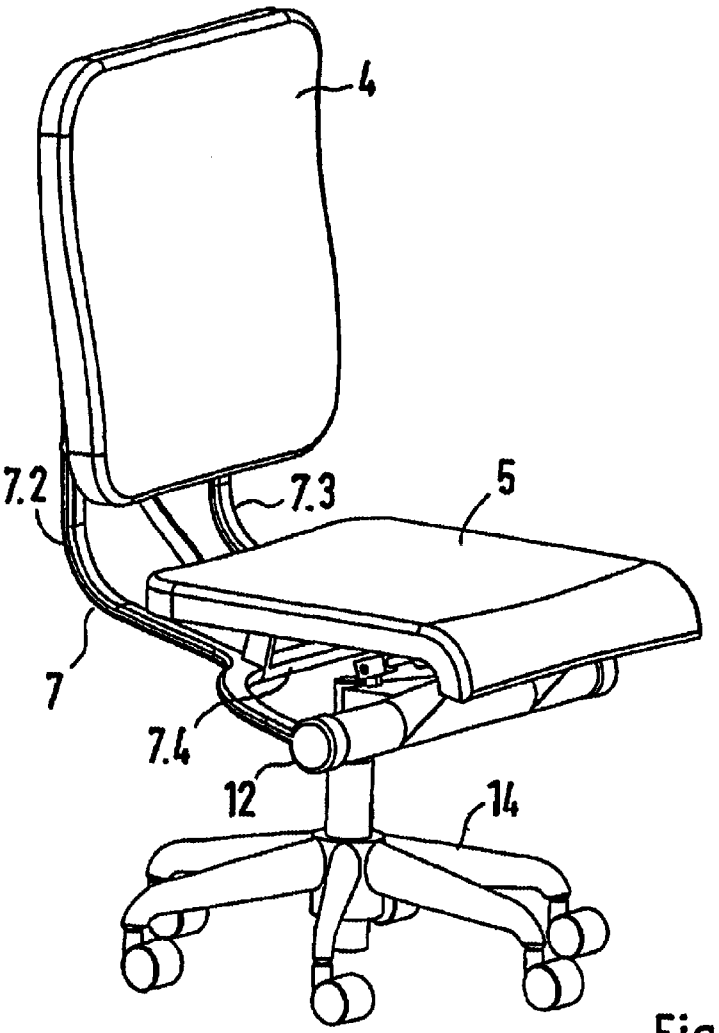
FIGS. 8 and 9 show two different perspective plan views of a chair in accordance with FIG. 6 or FIG. 7.
Figure 8:
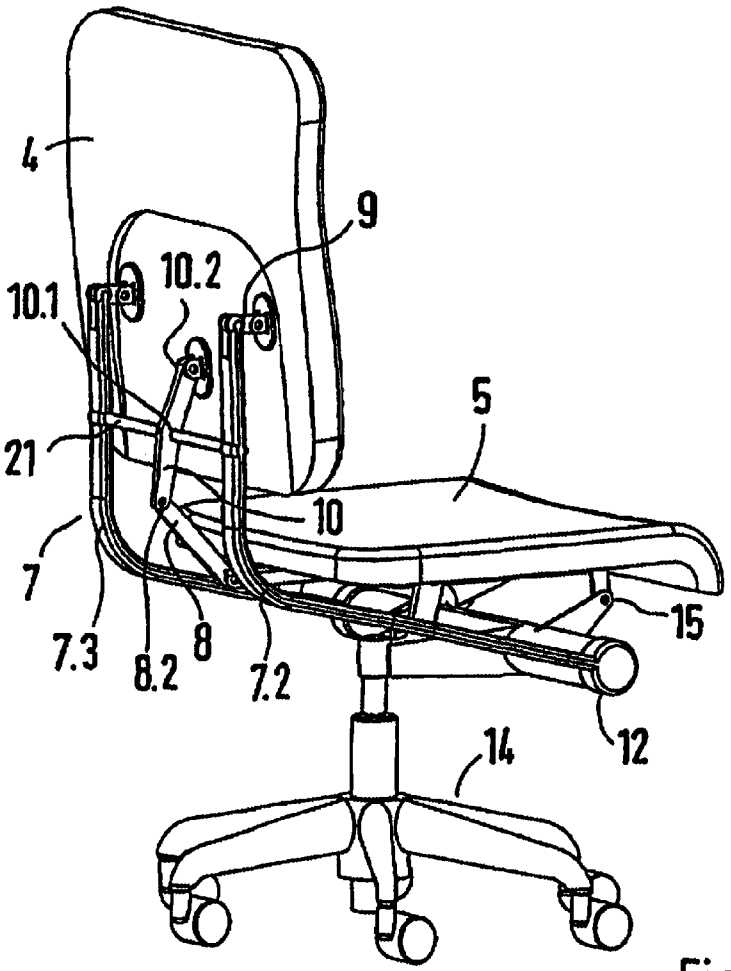

As shown in FIGS. 8 and 9, the rocker 7 has two lateral rocker elements, which extend approximately parallel with each other, wherein their distance in the front area of the seat is increased by an intermediate section. The two rocker elements 7.2 and 7.3 are connected with each other under the seat by a cross brace 7.4, and in the area of or near the backrest 4 by the coupling member 21. The control lever arrangement with the coupling element 8 and the lever 10 is arranged between the two rocker elements 7.2, 7.3 approximately in a vertical center plane.

An expanded synchronization mechanism is formed by the rockers 7 and the control lever arrangement with the lever 10 and the coupling element 8, as well as the respective connections with the seat 5 and the backrest 4 which, in comparison with a conventional synchronization mechanism, results in an enlarged opening angle $\alpha$, as shown by the comparison of FIG. 1 with FIG. 2, which represents the conventional synchronization mechanism. With the instant expanded synchronization mechanism, during a backward tilt the backrest is also tilted backward by the control lever arrangement with respect to the upward extending section of the rocker 7. At the same time, with a backrest 4 tilted further backward, a relative movement I between the back and the backrest 4, a hollow space 2 between the pelvis and the lower area of the backrest, as well as a change in the distance 3 between the rear edge of the backrest 4 and the rear edge of the seat 5 are prevented, so that practically no shirt-pushing effect, rear rolling of the pelvis, or a gap between the backrest and the seat results.

Figure 5:
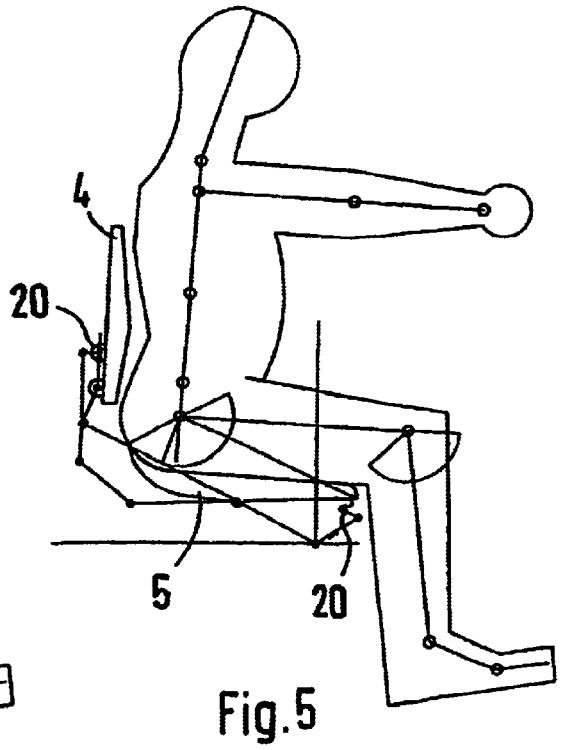
FIG. 5 shows a schematic representation of a further variation of the synchronization mechanism.

Besides rotary joints, thrust linkages can also be considered for the movement. For example, in FIG. 5 linear guides 20 are possible in the front area of the seat for placing the seat rocker 11 and instead of the articulated connection 9.2. The synchronization ratio can be affected by the length and distance of the levers. It is possible to select spring elements, such as tension, pressure, torsion or gas pressure springs for a suitable weight compensation during seating. A gas pressure spring 16 is shown in FIG. 6.

Figure 10:
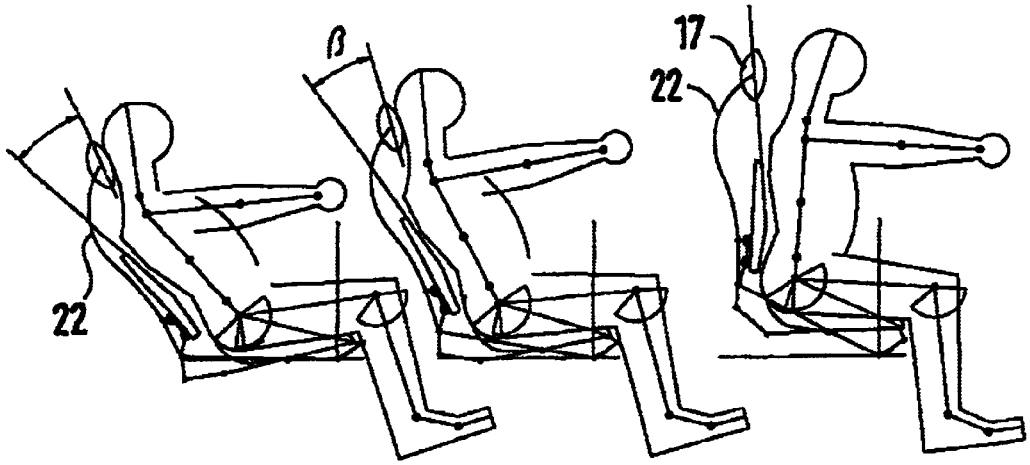
FIG. 10 shows three schematic position representations in connection with three different tilted positions of a chair with a synchronization mechanism and a head support.

A head support 17 can be arranged on an appropriate extension 22 above the upper edge of the backrest 4 which can be a one-piece, suitably shaped extension of the rocker 7, as shown in FIG. 10. If the head support 17 is rigidly connected to the rocker 7, a relative movement between the head support 17 and the backrest 4 occurs. With increasing backward tilt, the head support 17 is brought forward and thus aids the relief of the neck muscles, while preserving the field of view. Because of the relative movement between the head support 17 and the backrest 4, the head is tilted forward by an angle p when the opening angle a is increased. In this way relaxed working is possible even with a large backward tilt.

Figure 4:
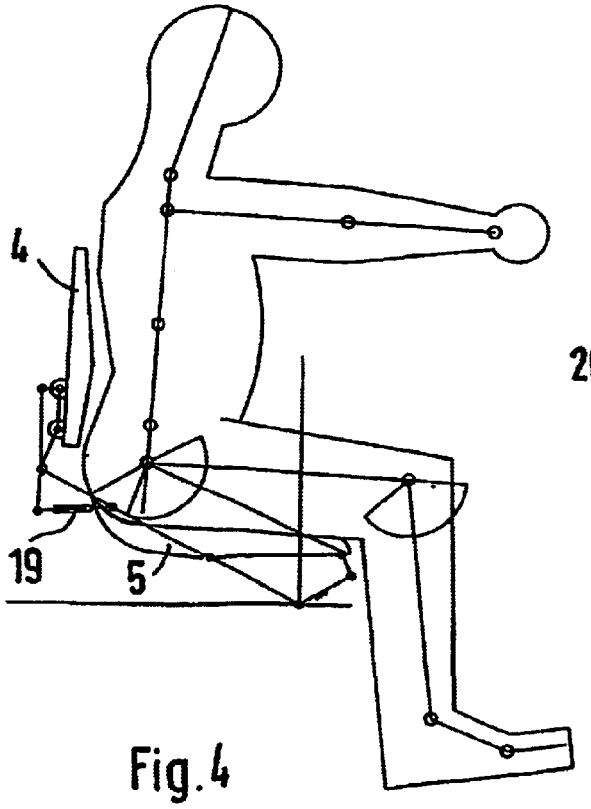
FIG. 4 shows a schematic representation of variation of the synchronization mechanism.

Suitable alternatives are available if no coupling element is provided and the backrest 4 can be separately adjusted, as shown in FIG. 4. The lever 10 can then be separately released by a, manual adjustment element 19, for which a gas pressure spring is suitable, for example. The length of the coupling rod 8 can be adjustable, by means of which an adjustment possibility of the backrest tilt is offered. For minimizing the structural space and number of parts it is possible to employ thrust linkages in place of rotary joints. A conventional synchronization mechanism can be achieved by removing the coupling element 8 and locking the backrest joints.

What is claimed is:

1. In a chair, including a work chair or an office chair, having a seat (5) placed on a chair frame (13) which can be tilted in a front area around a horizontal pivot shaft (15), which can be moved up and down on a spatial guide curve relative to the chair frame (13), and which is hingedly connected to a rocker (7) extending toward a rear from an articulated rocker bearing (12) fixed on the chair frame (13) and is one of spaced apart from a seat rear edge and laterally guided upward next to the seat (5), and having a backrest (4) coupled to an upward guided section of the rocker (7), and having a tilt forcibly changed superproportionally when a tilting of the seat (5) is changed, the improvement comprising:

the backrest (4) hingedly coupled with the rocker (7) via a coupling point (9.1), and the seat (5) coupled with the backrest (4) via a control lever arrangement (8, 10) for tilting the backrest (4) backward with respect to the rocker (7) when the seat (5) is tilted backward.

2. In the chair in accordance with claim 1, wherein the rocker bearing (12) has a torsion rod which prestresses the rocker (7) against a setting limitation, which limits a tilting position toward the front.

3. In the chair in accordance with claim 2, wherein the control lever arrangement has a lever (10) articulated on the upward guided section of the rocker (7) at a joint location (10.1) below the coupling point (9.1), which is hingedly coupled by an upper lever section via a connecting point with the backrest (4), and is hingedly coupled by a lower lever section with a rear area of the seat (5).

4. In the chair in accordance with claim 3, wherein a coupling piece (8) is hingedly connected at a lever connection point (8.2) of the lower lever section and is hingedly connected at a seat connection point (8.1) of the rear area of the seat (5).

5. In the chair in accordance with claim 4, wherein one of the control lever arrangement (8, 10) is connected in the rear area of the seat (5) to a lower seat element (5.1) one of underneath and at a side of the seat support (5.2), and a lower seat element (5.1) projects beyond the rear edge of the seat support (5.2), and the control lever arrangement (8, 10) is connected to a projecting section of the lower seat element (5.1).

6. In the chair in accordance with claim 5, wherein a backrest rocker (9) is provided by one of: two articulated connections (9.1, 9.2) at the ends for connecting the chair backrest (4) to the upward guided section of the rocker (7); and at least one thrust linkage (20).

7. In the chair in accordance with claim 6, wherein one of: for connecting the seat (5) with the chair frame (13), seat rockers (11) are arranged on both sides underneath the front area of the seat (5), one end of which is hingedly placed on the pivot shaft (15) and the other end on the front area of the chair frame (13); and a thrust linkage (20) is provided in a frontal seat area.

8. In the chair in accordance with claim 7, wherein the seat (5) is connected between a center area and the rear area with one of a connecting piece (7.1) and hingedly directly with the rocker (7).

9. In the chair in accordance with claim 8, wherein two lateral rocker elements (7.2, 7.3) are connected with each other by at least one cross brace (7.4, 21) and each of the lateral rocker elements (7.2, 7.3) has a forward projecting section that extends at a distance underneath the seat (5) and an upward extending section one of spaced apart from a back of the backrest (4) and positioned laterally of the back of the backrest (4).

10. In the chair in accordance with claim 9, wherein the control lever arrangement (8, 10) extends in an approximately central vertical plane between the two rocker elements (7.2, 7.3) and is spaced apart from the back of the backrest (4).

11. In the chair in accordance with claim 10, wherein a spring has a force that acts in a pulling direction between the articulated connecting point (10.2) and the coupling point (9.1) at the rocker.

12. In the chair in accordance with claim 11, wherein a head support (17) is coupled to an extension (22) which projects beyond the upper edge of the backrest (4), of a lever mechanism for synchronous adjustment of the seat (5) and the backrest (4), and the lever mechanism is embodied so that when the backrest (4) is tilted back the head support (17) is tilted back over a narrower tilt angle than the backrest.

13. In the chair in accordance with claim 12, wherein the extension (22) is one of a rigid and a hingedly connected, mechanically controlled extension portion.

14. In the chair in accordance with claim 13, wherein a length of the coupling piece (8) is changeable.

15. In the chair in accordance with claim 13, wherein the lever (10) is connected with the rear area of the seat (5) by a manually actuable adjusting element (19).

16. In the chair in accordance with claim 6, wherein a spring has a force that acts in a pulling direction between the articulated connecting point (10.2) and the coupling point (9.1) at the rocker.

17. In the chair in accordance with claim 4, wherein a length of the coupling piece (8) is changeable.

18. In the chair in accordance with claim 3, wherein the lever (10) is connected with the rear area of the seat (5) by a manually actuable adjusting element (19).

19. In the chair in accordance with claim 1, wherein the control lever arrangement has a lever (10) articulated on the upward guided section of the rocker (7) at a joint location (10.1) below the coupling point (9.1), which is hingedly coupled by an upper lever section via a connecting point with the backrest (4), and is hingedly coupled by a lower lever section with a rear area of the seat (5).

20. In the chair in accordance with claim 19, wherein a coupling piece (8) is hingedly connected at a lever connection point (8.2) of the lower lever section and is hingedly connected at a seat connection point (8.1) of the rear area of the seat (5).

21. In the chair in accordance with claim 1, wherein one of the control lever arrangement (8, 10) is connected in a rear area of the seat (5) to a lower seat element (5.1) one of underneath and at a side of the seat support (5.2), and a lower seat element (5.1) projects beyond the rear edge of the seat support (5.2), and the control lever arrangement (8, 10) is connected to a projecting section of the lower seat element (5.1).

22. In the chair in accordance with claim 1, wherein a backrest rocker (9) is provided by one of: two articulated connections (9.1, 9.2) at the ends for connecting the chair backrest (4) to the upward guided section of the rocker (7); and at least one thrust linkage (20).

23. In the chair in accordance with claim 1, wherein one of: for connecting the seat (5) with the chair frame (13), seat rockers (11) are arranged on both sides underneath the front area of the seat (5), one end of which is hingedly placed on the pivot shaft (15) and the other end on the front area of the chair frame (13); and a thrust linkage (20) is provided in a frontal seat area.

24. In the chair in accordance with claim 1, wherein the seat (5) is connected between a center area and a rear area with one of a connecting piece (7.1) and hingedly directly with the rocker (7).

25. In the chair in accordance with claim 1, wherein two lateral rocker elements (7.2, 7.3) are connected with each other by at least one cross brace (7.4, 21) and each of the lateral rocker elements (7.2, 7.3) has a forward projecting section that extends at a distance underneath the seat (5) and an upward extending section one of spaced apart from a back of the backrest (4) and positioned laterally of the back of the backrest (4).

26. In the chair in accordance with claim 25, wherein the control lever arrangement (8, 10) extends in an approximately central vertical plane between the two rocker elements (7.2, 7.3) and is spaced apart from the back of the backrest (4).

27. In the chair in accordance with claim 1, wherein a head support (17) is coupled to an extension (22) which projects beyond the upper edge of the backrest (4), of a lever mechanism for synchronous adjustment of the seat (5) and the backrest (4), and the lever mechanism is embodied so that when the backrest (4) is tilted back the head support (17) is tilted back over a narrower tilt angle than the backrest.

28. In the chair in accordance with claim 2, wherein the extension (22) is one of a rigid and a hingedly connected, mechanically controlled extension portion.

* * * * *